United States Patent [19]

Horowitz et al.

[11] 4,033,852

[45] July 5, 1977

[54] PROCESS FOR TREATING COAL AND PRODUCTS PRODUCED THEREBY

[75] Inventors: Carl Horowitz; Michael Dichter, both of Brooklyn, N.Y.

[73] Assignee: Polygulf Associates, New York, N.Y.

[22] Filed: June 26, 1975

[21] Appl. No.: 590,696

[52] U.S. Cl. ..... 208/8; 208/9; 44/1 R

[51] Int. Cl.² ..... C10G 1/04

[58] Field of Search ..... 208/8–10; 44/1 R, 6

[56] References Cited

UNITED STATES PATENTS

| | | | |
|---|---|---|---|
| 1,844,998 | 2/1932 | Wietzel et al. | 208/10 |
| 1,845,555 | 2/1932 | Pier et al. | 208/10 |
| 2,133,280 | 10/1938 | Burk | 208/8 |
| 2,194,439 | 3/1940 | Chittick | 44/6 |
| 3,069,293 | 12/1962 | Booth | 44/6 |
| 3,893,943 | 7/1975 | Willard | 44/1 R |

*Primary Examiner*—Delbert E. Gantz
*Assistant Examiner*—James W. Hellwege
*Attorney, Agent, or Firm*—Amster & Rothstein

[57] ABSTRACT

Novel modified coal products, which are more easily liquified as compared to natural coal, are produced by a process comprising activating coal with free radical or ionic catalyst systems and thereafter, reacting the activated coal with vinyl monomers to attach polymeric side chains to the coal.

12 Claims, No Drawings

PROCESS FOR TREATING COAL AND PRODUCTS PRODUCED THEREBY

This invention relates to improved techniques for the liquification of coal. More particularly, the invention pertains to processes for the modification of coal to produce novel modified coal products which are more readily liquifiable than coal in its natural state.

Coal, as a natural source of fuel, is abundantly available in the United States as compared to oil, or other sources of energy. In the wake of recent energy shortages and increased oil prices, coal has once again attracted large scale attention as an energy source. As a result, interest has been re-kindled in technology for converting coal into liquid and gas products which can be substituted for oil and natural gas.

A variety of processes for converting coal to oil or gas have been proposed or used in the past. Such processes include coal distillation in the presence of hydrogen and a catalyst, as more fully described in U.S. Pat. No. 3,244,615; hydrogenation of coal as described in U.S. Pat. Nos. 3,143,489, 3,162,594, 3,502,564 and others; and solvent extraction processes as exemplified by U.S. Pat. No. 3,018,241. A recent survey of such coal conversion technology appears in an article entitled "Coal Conversion Technology", published in the July 22, 1974 issue of *Chemical Engineering*. Such techniques have typically required high energy input, as well as the utilization of high temperature and high pressure equipment, thereby making the widespread use of such techniques economically unfeasible.

It is an object of the present invention to produce modified coal having enhanced solubility and a lower melting point than the original coal, such that it may either be directly liquified or subjected to further processing; e.g., solvent extraction or refining techniques to produce liquified coal.

It is another object of the present invention to provide modified coal having a molecular structure and other properties, allowing it to be dissolved at low temperature and pressure in common hydrocarbon liquid fuels so as to extend their volume and mass with an equivalent or improved energy output.

In accordance with the present invention, the novel modified liquid or solid coal products are obtained by a process which involves the molecular or chemical grafting and polymerization of selected monomers to the original coal substrate. More particularly, the process of the present invention comprises the steps of contacting pulverized coal with selected free radical or ionic catalyst systems to provide reaction sites on the coal and reacting the activated coal substrate thereby formed with selected monomers in the presence of said catalysts to produce side chains of polymerized monomers which are chemically bonded to the activated sites. These polymeric side chains impart desirable new properties to the coal without damaging any of the positive attributes of the starting coal material.

While not wishing to be limited to any particular theory, it is known that coal is a crystalline aggregate having a very complex molecular structure (see for example, Huntington U.S. Pat. No. 3,244,615) in which the carbon atoms in the coal molecule are present in polynuclear aromatic rings and the other elements such as sulfur, nitrogen, oxygen, etc. are distributed in this matrix as sulfides, thiols, amines, imines and hydroxyl groups without disturbing the aromatic configuration. The average molecular weight of the polynuclear aromatic molecular is more than 2000. The molecules of coal are highly resonance stabilized, symmetrical in structure and arranged in planar configuration. This configuration results in extremely high cohesive forces and a compact state of aggregation which render liquifaction and solubilization of coal extremely difficult. It is believed that molecular grafting of polymeric side chains on the coal molecule in accordance with the present invention breaks down this crystalline symmetry, thereby producing a more amorphous structure having lower intermolecular forces. The cumulative effect is to increase the solubility of coal in suitable organic solvents and to facilitate its conversion to a liquid.

The process of grafting polymeric side chains onto coal to produce the novel coal products of the invention involves the steps of contacting pulverized coal with an appropriate catalyst at an elevated temperature for a time sufficient to generate coal radicals and thereafter, reacting said radicals with a suitable monomer under conditions appropriate for the addition of the monomer to the coal radicals and the subsequent polymerization of the monomer.

Activation of the coal substrate to produce a coal radical is a critical step in the process of the invention. Coal radicals may be produced by utilizing radiation techniques which are well known in the art or a variety of free radical, anionic or cationic catalyst systems. Free radical graft initiator systems or ionic catalysts are preferred. In the free radical approach, the graft polymerization initiator is silver ions which may be derived from metallic silver or from silver salts such as silver nitrate, silver perchlorate or silver acetate. The free radical system also includes a peroxide polymerization initiator which serves to generate free radicals as well as to convert atomic silver to active silver ions. Any of a wide variety of well known peroxide-type initiators may be employed including, for example, benzyl peroxide, methyl ethyl ketone peroxide, tertiary butyl hydroperoxide, hydrogen peroxide, ammonium persulfate, ditertiary butyl peroxide, tertiary butyl perbenzoate and peracetic acid. The free radical initiator systems are more fully described in U.S. Pat. Nos. 3,401,049 and 3,698,931.

It is presently believed that the free radical catalyst system activates the adventitious

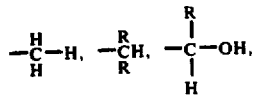

—SH, —COOH groups present on the coal molecule to produce a coal radical in accordance with the following reaction:

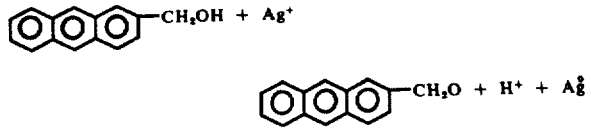

A monomer ($CH_2{=}CHX$ where X is any of a wide variety of organic or inorganic substituents) is then added to the activated coal radical in accordance with the following reaction:

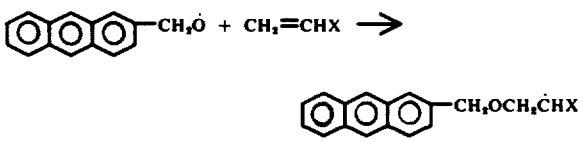

Polymerization of the added monomer may then occur as a result of the addition of further monomers as follows:

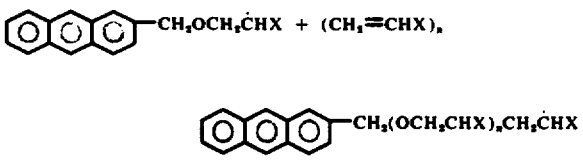

Termination of the polymerization reaction will occur as a result of chain transfer with other coal molecules, thereby generating additional coal radicals which may participate in further graft polymerization reactions. Alternatively, termination may occur as a result of a reaction with free radicals generated by the perioxide initiators to produce silver ions in accordance with the following reactions:

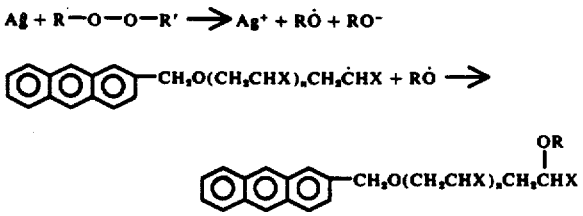

As an alternative to the free radical catalyst system an ionic catalyst such as a sodium napthalene charge transfer complex may be employed. Such a catalyst system is believed to produce an activated coal radical in accordance with the following reaction:

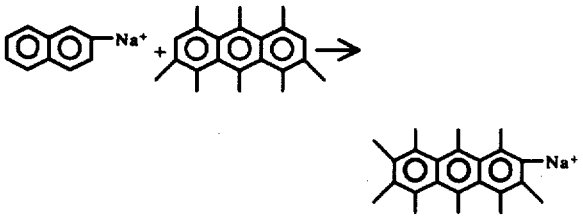

The activated coal may then initiate polymerization of olefinic monomers as follows:

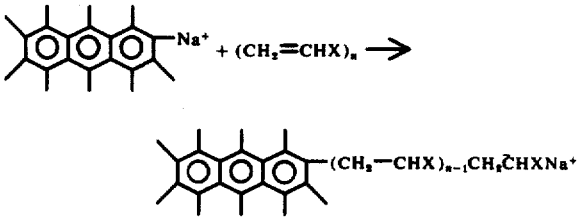

As in the case of the free radical system, termination of the polymerization reaction will occur as a result of chain transfer with coal molecules present in the system because of their high concentration, thereby generating additional coal radicals which may participate in further graft polymerization reactions.

Any polymerizable monomer, preferably an olefinically unsaturated monomer, may be employed to produce the modified coal products of the invention. Typical polymerizable monomers include: ethylene; propylene; butylene; tetrapropylene; isoprene; butadiene; olefinic petroleum fractions; styrene; vinyltoluene; methylmethacrylate; ethylacrylate; ethylhexylacrylate; tertiarybutylacrylate; oleylacrylate and methacrylate, stearylacrylate and methacrylate; mirystyl acrylate and methacrylate; lauryl acrylate and methacrylate; vinyloleate; vinylstearate; vinyl mirystate, vinyl laurate, or combinations of the above materials. It will readily occur to those persons skilled in the art that by appropriate selection of the monomer the relative solubility of the modified coal products in various liquid mediums may be controlled. For example, monomers having nonpolar alkyl substituents such as methyl ethyl, propyl, etc. will enhance the solubility of the modified coal in aliphatic hydrocarbons, whereas phenyl, methylphenyl, etc. pendant groups will yield a species soluble in aromatic solvents. On the other hand, polar groups such as hydroxyl, positive or negative pendant groups will render the grafted coal insoluble in any of the above-mentioned solvents.

The type of coal employed to produce the modified coal products of the invention is not critical. Accordingly, it is within the concept of the present invention to produce modified coal products from bituminous coal, sub-bituminous coal, anthracite, lignite or other solid carbonaceous materials of natural origin. Ordinarily, the coal will be pulverized so as to provide a large surface area for carrying out the contemplated reaction.

The process of the invention will normally be carried out in a solvent or other fluid medium capable of dispersing the reactants and catalyst so that the reactions will proceed efficiently. The choice of solvent is not critical and will normally be dictated by such factors as cost, ease of recovery (where desired) and compatibility with the monomer being employed to produce the modified coal products of the invention. A wide variety of solvents are useful for this purpose, including dimethylformamide, tetrahydrofurane, tetrahydrofurfuryl alcohol, dimethylsulfoxide, water, methyl, ethyl or isopropyl alcohol, acetone, methyl ethyl ketone, ethyl acetate, and a wide variety of hydrocarbons including benzene, toluene, xylene, hydrocarbon fractions such as naphtha, medium boiling petroleum fractions (boiling point 100°–180° C.), or mixtures of one or more of the foregoing materials. By employing solvents for the novel modified coal products of the invention; e.g., hydrocarbon solvents such as benzene or naphtha, the solvent may be employed to serve a dual function; i.e., to serve as an extracting agent in the separation of the modified coal products from unreacted coal, in addition to serving as a reaction medium.

The conditions employed to form the modified coal products of the invention are not critical. Ordinarily, the process will be carried out at a temperature in the range of 25° to 150° C., preferably 30° to 75° C. for a time sufficient to permit the reaction to go to completion; e.g., 1 to 2 hours. Although the process may be carried out under pressure, if desired; e.g., 1 to 50 atmospheres, it is an advantageous feature of the invention that the high pressures normally associated with prior art coal liquifaction processes are not required.

The amounts of the reactants employed are also not a critical feature of the invention. For obvious economic reasons, the amounts of monomer and catalyst employed in the system will be the minimum amounts necessary to alter the crystalline coal structure as previously described herein. The amount of monomer employed will normally range from 0.5 to 10 wt.% of the amount of coal employed. The amounts of catalyst required are relatively small, particularly in view of the heretofore-noted tendency to generate coal radicals by chain transfer. In the free radical catalyst system, the amount of catalyst may range between 0.01 to 0.05 wt.%, preferably 0.01 to 0.02 wt.% of the amount of monomer employed with lower amounts being preferred for reasons of economy. The amount of peroxide initiator employed will normally range between 0.5 to 2.5 wt.% of the amount of monomer employed, preferably 1.0 to 2.0 wt.%. When the ionic catalyst is employed, it will normally be present in an amount of 0.5 to 5.0 wt.%, preferably 2.0 to 3.0 wt.% of the amount of monomer employed.

The invention will be further understood by reference to the following illustrative examples.

EXAMPLE I

Pittsburgh coal having the following composition was pulverized and passed through a 200 mesh seive:

| | | |
|---|---|---|
| volatiles | 38.2% | (at coking temperature) |
| ash | 6.37% | |
| sulfur | 1.22% | |
| moisture | 4.80% | |
| fixed carbon | 49.41% | |

The coal was heated at 110° C. until a constant weight of 100 grams of coal was obtained. Thereafter, the coal was dispersed in a three-necked flask fitted with condenser and stirrer and 200 ml. of benzene was added to form a slurry. 0.1 grams of benzoyl peroxide and 25 ppm. of silver perchlorate were added to the slurry and the slurry was then heated at 65° to 70° C. for one (1) hour. Thereafter, 10 grams of styrene monomer was added to the slurry and the heating was continued for an additional one (1) hour period. The contents of the flask were then cooled-down and the solid portion of its contents was separated by filtration. The filtrate was then vacuum distilled to remove unreacted monomer and solvent, leaving behind a highly viscous liquid. The undissolved solids from the filtration step were extracted with benzene in a sohxlet extractor for two (2) hours at a temperature of 60°–70° C. Thereafter, the benzene solvent was removed by distillation leaving a viscous liquid. The viscous liquids obtained from the foregoing operations were combined and heated at about 80° C. under vacuum, until a constant weight was obtained. The weight was 19.65 grams.

In a separate experiment, 100 grams of dried coal were treated with benzene under reflux conditions for four (4) hours. The filtrate was dried under vacuum, leaving about 5 grams of a viscous liquid.

A comparison of the foregoing procedures clearly indicates that almost four times as much coal was liquified as a result of carrying out the process of the invention, as compared to extraction of the coal using an identical solvent.

EXAMPLE II 100 grams of dried coal (200 mesh) were dispersed in 200 grams of water. One (1) gram of acetyl peroxide and 25 ppm. of silver nitrate were added to this slurry and the slurry was heated to 80°–85° C. for one (1) hour. Thereafter, 10 grams of acrylic acid was added to the slurry and heating was continued at 80°–85° C. for an additional one (1) hour. The reacted coal was washed with de-ionized water and dried. One (1) gram of treated coal and one (1) gram of untreated coal were dispersed separately in 50 ml. of water each and the pH of the two (2) solutions were measured. The pH of the original coal solution was 7.6 and the pH of the coal treated in accordance with the process of this invention was 6.2. This experiment illustrates that a substantial amount of the acrylic acid monomer had combined with the coal.

EXAMPLE III 100 grams of pulverized coal (200 mesh) were treated with 2 ml. of sodium naphthalene complex (15% solution in diglyme) at room temperature for one (1) hour. 10 grams of a low-boiling gasoline fraction containing about 50% unsaturation (light cooker gasoline obtained from Getty Oil Co.) was added and the treatment was continued for an additional one (1) hour. Solids were separated from the slurry by filtration, leaving behind a viscous liquid. The solid residue was extracted with benzene, as described in Example 1. The residual solids (coal) after the extraction step were dried to a constant weight of 79.2 grams. The experiment illustrates that 21% of the coal had been liquified to a viscous liquid, as a result of the process of the invention.

EXAMPLE IV

In order to determine if coal can be continuously reacted and extracted, a series of experiments similar to Example III were carried out utilizing a total of 100 grams of pulverized Pittsburgh coal, less than 1 gram of catalyst, and 20 grams of monomer. In each experiment the coal was subjected to four (4) successive reaction and extraction steps utilizing 5 grams of monomer and 200 cc. of benzene in each step. The results of utilizing this method with different monomers is set forth in Table 1.

Table 1

| WEIGHT LOSS IN GRAMS FROM 100 GRAMS OF COAL | | | |
|---|---|---|---|
| EXTRACTION STEPS | Heavy Unsaturated Oil Fraction | Octadiene Monomer | Light Coke Gasoline Monomer |
| 1st | 24.5 | 20.1 | 18.5 |
| 2nd | 6.0 | 5.0 | 5.3 |
| 3rd | 5.0 | 4.5 | 4.0 |
| 4th | 3.0 | 2.5 | 2.8 |
| TOTAL | 38.5 | 32.1 | 30.6 |

The filtrate in each case was a dark viscous liquid which could be completely re-dissolved in benzene. This shows that extracted coal can further be reacted to give extractable products and hence the process can be operable on a continuous basis.

An analysis of the sulfur content of the grafted coal products (viscous liquid) produced as a result of each set of reaction and extraction steps with the heavy unsaturated oil fraction monomer reveals that the process of the invention results in a liquid coal product having reduced sulfur content as compared to the original coal which had a sulfur content of 1.2%. The results are summarized below:

| EXTRACTIVE REACTION STEP | PERCENT SULFUR CONTENT IN FILTRATE |
|---|---|
| 1st Fraction | 0.33 |
| 2nd Fraction | 0.32 |
| 3rd Fraction | 0.30 |
| 4th Fraction | 0.32 |

It will be understood that the foregoing illustrative examples are intended only to demonstrate that the process of the invention is capable of producing a novel grafted coal product having enhanced solubility characteristics such that it is more readily liquifiable than natural coal. A wide variety of applications of this invention for the recovery of coal and the conversion of coal to useful liquid fuel products will readily occur to those persons skilled in the art.

What is claimed is:

1. A process for grafting polymeric side chains onto natural coal which comprises contacting natural coal with a catalyst system selected from the group consisting of a free radical catalyst system comprising a source of silver ions and a peroxide polymerization initiator and an ionic catalyst system comprising a sodium naphthalene charge transfer complex to produce coal radicals and reacting said coal radicals with an olefinically unsaturated monomer for a time sufficient to produce a grafted coal product having polymeric side chains bonded to said coal.

2. The process of claim 1, wherein said coal and said monomer are contacted for a period of 10 to 60 minutes at a temperature of 30° to 150° C.

3. The process of claim 1, wherein the amount of monomer employed is in the range of 0.5 to 10 wt.% of the amount of coal.

4. The process of claim 1, further including a fluid medium for dispersing the reactants and catalyst.

5. The process of claim 4, wherein said fluid medium is a solvent for said grafted coal product and said grafted coal product is extracted from the reaction mixture to produce a liquified coal product.

6. The process of claim 4, wherein said fluid medium is benzene.

7. The process of claim 4, wherein said fluid medium is a medium boiling point petroleum fraction.

8. A process for grafting polymeric side chains onto natural coal which comprises dispersing natural coal, 0.5 to 10 wt.% based on said coal of an olefinically unsaturated monomer and a catalyst system selected from the group consisting of a free radical catalyst system comprising a source of silver ions and a peroxide polymerization initiator and an ionic catalyst system comprising a sodium naphthalene charge transfer complex in a fluid medium, heating the aforesaid material at a temperature of 25° to 150° C. to produce coal radicals and to react said coal radicals with said monomer to produce a grafted coal product.

9. The process of claim 8, wherein said fluid medium is a solvent for said grafted coal product and the grafted coal product is extracted from the reacted mixture of ingredients upon completion of the heating step to produce a liquified coal product.

10. A modified coal product having grafted polymeric side chains chemically bonded to natural coal, said coal product being the reaction product of coal radicals formed from natural coal in the presence of a catalyst system selected from the group consisting of a free radical catalyst, the system comprising s source of silver ions and a peroxide polymerization initiator and an ionic catalyst system comprising a sodium naphthalene charge transfer complex and a polymerizable monomer.

11. The product of claim 10, wherein said polymerizable monomer is an olefinically unsaturated monomer.

12. The product of claim 10, further including a solvent for said grafted coal product.

* * * * *